United States Patent [19]

Satake et al.

[11] Patent Number: 4,573,062

[45] Date of Patent: Feb. 25, 1986

[54] THERMOSENSITIVE RECORDING SHEET

[75] Inventors: Toshimi Satake; Toshiaki Minami, both of Tokyo; Fumio Fujimura, Omoiya; Satoshi Oda; Masato Magami, both of Nakatsu, all of Japan

[73] Assignees: Jujo Paper Co., Ltd., Tokyo; Yoshitomi-Pharmaceutical Ind., Ltd., Osaka, both of Japan

[21] Appl. No.: 708,947

[22] Filed: Mar. 6, 1985

[30] Foreign Application Priority Data

Mar. 7, 1984 [JP] Japan ..... 59-42130
May 8, 1984 [JP] Japan ..... 59-91363

[51] Int. Cl.[4] ..... B41M 5/18

[52] U.S. Cl. ..... 346/209; 346/208; 346/216; 346/225; 427/150

[58] Field of Search ..... 346/208, 209, 216, 217, 346/225; 427/150, 151, 152

[56] References Cited

U.S. PATENT DOCUMENTS 4,444,844 4/1984 Kubo et al. ..... 346/208

FOREIGN PATENT DOCUMENTS 0182483 11/1982 Japan ..... 346/209
0203589 12/1982 Japan ..... 346/209

*Primary Examiner*—Bruce H. Hess
*Attorney, Agent, or Firm*—Sherman and Shalloway

[57] ABSTRACT

A thermosensitive recording sheet having a thermosensitive color developing layer containing a basic leuco dye and an organic color developer, said organic color developer consisting at least partly of a hydroxybenzoyloxybenzoic acid ester represented by the general formula (I)

(I)

wherein R represents an alkyl group, a cycloalkyl group, or an aryl, aralkyl or aryloxyalkyl group which may have at least one substituent selected from the class consisting of halogen atoms, nitro groups, hydroxyl groups, lower alkyl groups and lower alkoxy groups.

7 Claims, No Drawings

THERMOSENSITIVE RECORDING SHEET

This invention relates to a thermosensitive recording sheet, and more specifically, to a thermosensitive recording sheet which is suitable for high-density and high-speed recording and has excellent resistance to soiling by oily substances such as hair-dressing agents or oils and fats and excellent image stability.

Generally, thermosensitive recording sheets are obtained by grinding a colorless to light-colored basic leuco dye and an organic color developer such as a phenolic substance into fine particles, mixing the particles of both, adding a binder, a filler, a sensitivity increasing agent, a lubricant and other auxiliary agents to form a coating composition, and applying the coating composition in a thin layer to a support such as paper or a plastic film. The thermosensitive color developing layer forms a color imagewise by an instantaneous chemical reaction induced by heating and thereby permits recording of the image. Images of various colors can be obtained by properly selecting the type of the leuco dye.

In recent years, the thermosensitive recording method has gained widespread acceptance and found a diversity of applications, and it has been considered important to increase not only the speed of recording but also the density of recording for higher resolution or enhanced image quality. As a result, the thermal energy of a thermal printhead of a recording device tends to become increasing low, and therefore, thermosentitive recording sheets used in it are requird to have color forming sensitivity sufficient to obtain clear recorded color images even when the amount of thermal energy is low.

The thermosensitive recording sheets cannot avoid contact with human hands in view of their function as information recording media. Frequently, therefore, the fingers of persons who handle the sheet have adhering thereto oily substances such as hair-dressing agents used in everyday lives or oils and fats contained in the sweat from the skin, and there are many occasions on which the thermosensitive recording sheets undergo soiling or contamination by these oily substances. Generally, the thermosensitive recording sheets do not have sufficient stability to these soiling substances, and the density of the color image may be reduced or lost at a part soiled by such substances. Furthermore, soiling of the background portion often results in discoloration.

Many substances are described in various literature references including Japanese Patent Publication No. 14039/1970 as color developers for thermosensitive recording sheets, but 4,4′-isopropylidene diphenol (bisphenol A) is now used most widely because of its stable quality, cost and availability. However, since bisphenol A has a high heat color-developing temperature, it cannot fully adapt to recording by a small amount of thermal energy, and troubles such as sticking tend to occur.

In an attempt to meet the recent requirements for higher recording speeds and higher image quality, Japanese Laid-Open Patent Publication No. 144193/1981 proposes a thermosensitive recording sheet including a p-hydroxybenzoic acid ester as a color developer used in combination with a fluolane-type dye, and makes it clear that higher sensitivity with excellent dynamic color developability can be easily achieved by this thermosensitive recording sheet. But the thermosensitive recording sheet containing the p-hydroxybenzoic acid ester as a color developing agent has the defect that the density of an image formed by application of heat decreases with time, the so-called "crystallization" phenomenon occurs whereby crystals precipitate onto the surface of the image, and that the image area does not have sufficient stability to oily substances.

The use of monophenolsulfone compounds as the color developer was recently disclosed in Japanese Laid-Open Patent Publication Nos. 20493/1983, 82788/1983, 132593/1983, and 166098/1983. However, thermosensitive recording sheets comprising the monophenolsulfone compounds as the color developer still cannot fully respond to the aforesaid recording by a small amount of thermal energy, and cannot give as high dynamic recording densities as the thermosensitive recording sheets containing the p-hydroxybenzoic acid esters as the color developer.

Furthermore, on long-term storage, the recorded images may discolor or fade under external influences such as light, humidty and heat, and the background portion undergoes "backgrounding" whereby it is colored undesirably.

Japanese Laid-Open Patent Publication Nos. 45747/1974, 18752/1979 and 83495/1982 describe that phenolic antioxidants effectively act as stabilizers for improving the preservability of recorded images. The use of a large amount of such a stabilizer, however, tends to reduce the color developing sensitivity of the recording sheets because of its diluting effect.

It is an object of this invention to provide a thermosentive recording sheet capable of giving a clear and stable color image having a sufficiently high dynamic image density and excellent resistance to soiling substances such as hair-dressing agents or oils and fats.

Another object of this invention is to provide a thermosensitive recording sheet which can form a clear and stable dye image having a sufficiently high dynamic image density and excellent long-term preservability and undergoing little discoloration and fading by moisture, heat, etc., and which is free from backgrounding and has excellent resistance to soiling substances such as hair-dressing agents or oils and fats.

Further objects and advantages of this invention will become apparent from the following description.

According to this invention, there is provided a thermosensitive recording sheet having a thermosensitive color developing layer containing a basic leuco dye and an organic color developer, said organic color developer consisting at least partly of a hydroxybenzoyloxybenzoic acid ester represented by the general formula (I)

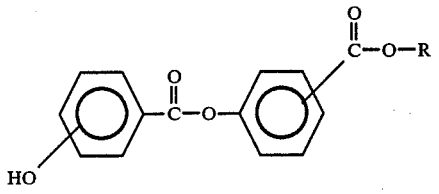

(I)

wherein R represents an alkyl group, a cycloalkyl group, or an aryl, aralkyl or aryloxyalkyl group which may have at least one substituent selected from the class consisting of halogen atoms, nitro groups, hydroxyl groups, lower alkyl groups and lower alkoxy groups.

The term "lower", as used herein to qualify a group or compound, means that the group or compound so qualified has not more than 5 carbon atoms.

The "alkyl group" in general formula (I) may be linear or branched, and includes, for example, methyl, ethyl, n-propyl, isopropyl, n-butyl, isobutyl, sec-butyl, tert-butyl, n-pentyl, isopentyl, n-hexyl, n-octyl, 2-ethylhexyl, isooctyl, nonyl and dodecyl groups. The "cycloalkyl groups" may have an alkyl group on the cycloaliphatic ring, and includes, for example, cyclopentyl, cyclohexyl, cycloheptyl, o-ethylcyclohexyl, and p-tert-butylcyclohexyl groups.

Examples of the "aryl group" are phenyl and alpha- or beta-naphthyl groups. The "aralkyl group" means an aryl-alkyl group, and particularly includes phenyl-lower alkyl groups such as benzyl, phenethyl, phenylpropyl and phenylbutyl groups. The "aryloxyalkyl group" includes phenyl-O-lower alkyl groups such as phenoxymethyl, phenoxyethyl, phenoxypropyl and phenoxybutyl groups. The aromatic ring (aryl moiety) in the "aryl group", "aralkyl group" and "aryloxyalkyl group" is unsubstituted, or may be substituted by at least one (preferably 1 to 3) substituent selected from halogen atoms such as fluorine, chlorine and bromine atoms, hydroxyl groups, lower alkyl groups such as methyl, ethyl, n-propyl, isopropyl, n-butyl, sec-butyl and tert-butyl groups, and lower alkoxy groups such as methoxy, ethoxy, n-propoxy, isopropoxy, n-butoxy, sec-butoxy and tert-butoxy groups.

Examples of preferred groups R in general formula (I) include alkyl groups having 1 to 12 carbon atoms, cycloalkyl groups having 5 to 10 carbon atoms, and groups of the following formulae

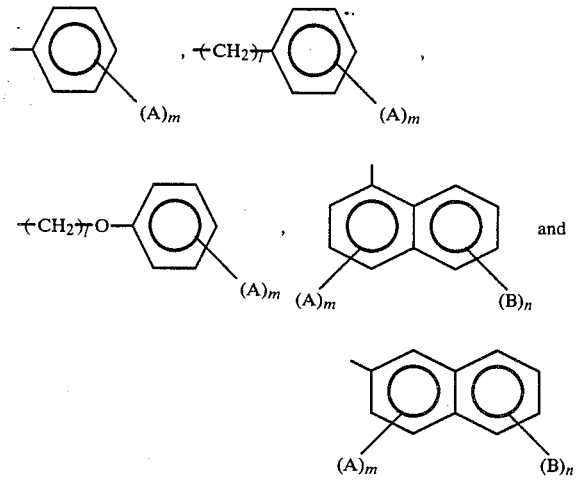

wherein A and B, independently from each other, represent a halogen atom, a nitro group, a hydroxyl group, a lower alkyl group or a lower alkoxy group, l is an integer of 1 to 5, and m and n are 0 or an integer of 1 to 3, provided that when m and n are 2 or 3, two or three groups A or B may be identical or different.

Especially preferred groups R are alkyl groups having 1 to 12 carbon atoms, especially lower alkyl groups, a cyclohexyl group, a benzyl group, a phenethyl group, an alpha-naphthyl group and a beta-naphthyl group.

In view of stabilizing ability, the availability of materials for synthesis, the ease of synthesis, and cost, preferred hydroxybenzoyloxybenzoic acid esters of general formula (I) are those of the following formula

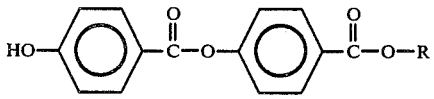

(I-1)

wherein R is as defined, in which —OH and

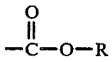

are both para to

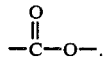

More preferred compounds are those of general formula (I-1) in which R is an alkyl group having 1 to 12 carbon atoms, preferably 1 to 5 carbon atoms, a cyclohexyl group, a benzyl group, a phenethyl group, an alpha-naphthyl group or a beta-naphthyl group in view of their melting range, sublimability and molecular weight and the sensitivity (thermal response) and oil resistance of a thermosensitive recording sheet containing such a compound.

Typical examples of the hydroxybenzoyloxybenzoic acid esters of formula (I) or (I-1) used in this invention are shown below without any intention of limiting the invention thereto.

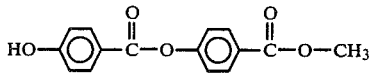

(1)

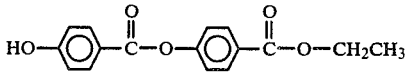

(2)

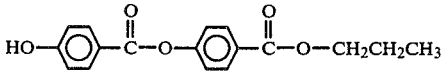

(3)

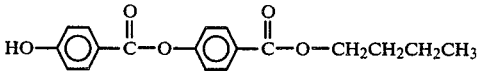

(4)

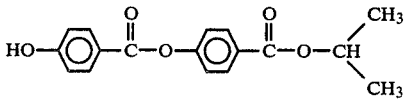

(5)

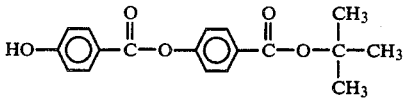

(6)

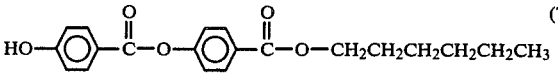

(7)

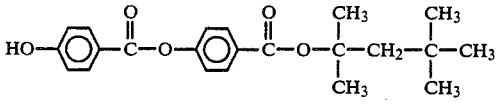

(8)

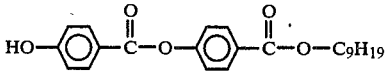

(9)

-continued
(10)
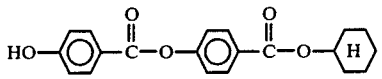
(11)
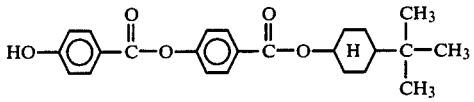
(12)
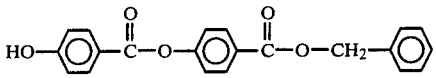
(13)
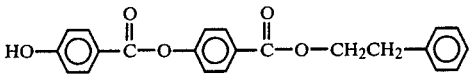
(14)
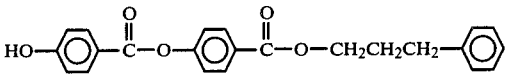
(15)
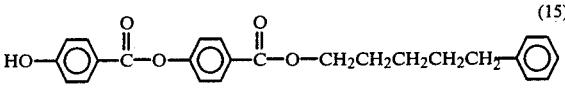
(16)
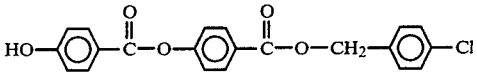
(17)
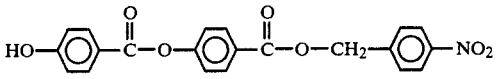
(18)
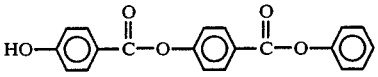
(19)
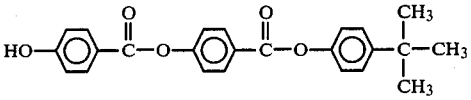
(20)
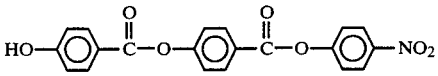
(21)
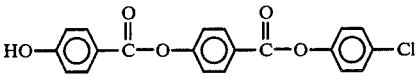
(22)
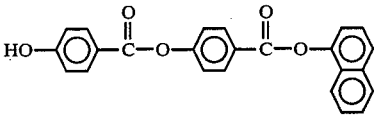
(23)
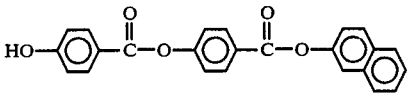
(24)
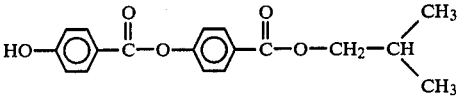
(25)
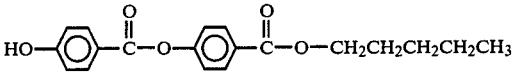
-continued
(26)
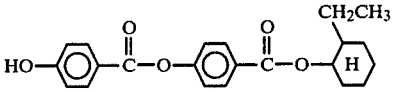
(27)
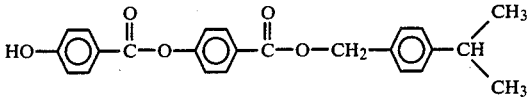
(28)
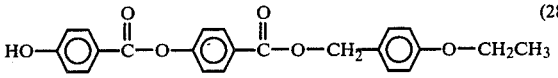
(29)
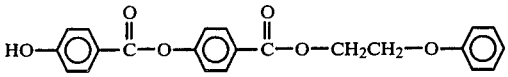
(30)
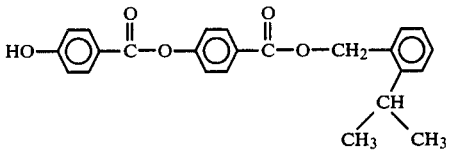
(31)
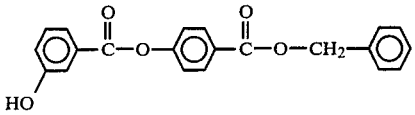
(32)
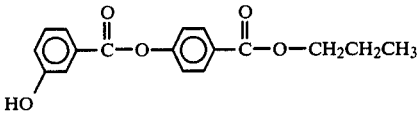
(33)
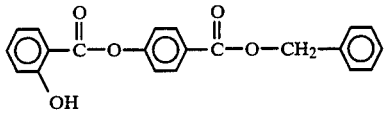
(34)
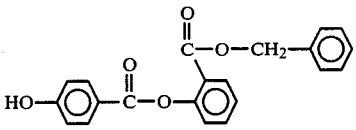
(35)
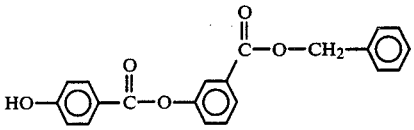
(36)
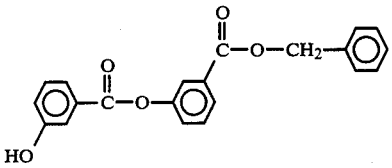
(37)
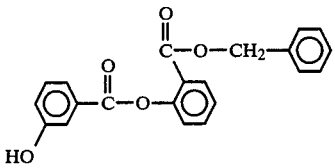

-continued (38)

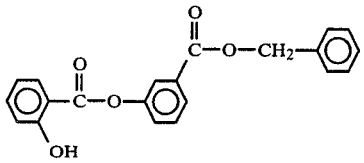

(39)

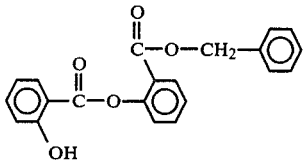

(40)

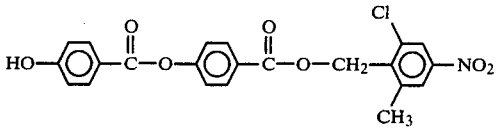

The compounds of formula (I) may be used singly or in combination with each other or with other types of organic color developers.

As stated above, conventional images obtained by thermosensitive recording have unsatisfactory storage stability. On long-term storage they are susceptible to discoloration or fading under external conditions such as humidity and temperature, or "backgrounding" occurs. Furthermore, when two or more organic color developers are used together, a coating composition for forming a thermosensitive recording layer may be colored during its preparation, and after coating, the resulting thermosensitive recording layer may undergo backgrounding with time.

It has now been found however that the compound of formula (I) in accordance with his invention not only functions as a color developer, but also has a very good effect of stabilizing both a coating composition for thermosensitive recording sheets and thermosensitive recording layers. Specifically, it has been found that the compound of formula (I) markedly increases the storage stability of images formed by thermosensitive recording, and even when used in combination of another type of organic color developer, does not cause coloration of the coating composition nor backgrounding of the thermosensitively colored layer.

The compound of formula (I) can be used as a major component of the color developer in an amount of at least 50 % by weight, preferably 60 to 100 % by weight, more preferably 70 to 100 % by weight, base on the total amount of the color developer. Alternatively, for the purpose of producing the aforesaid stabilizing effect, it may be used as a minor component of the color developer in an amount of, for example, 0.1 to 35 % by weight, preferably 1 to 30 % by weight, more preferably 5 to 25% by weight, based on the total amount of the color developing agent.

Examples of the other types of organic color developers that can be used in combination of the compound of formula (I) include bisphenol A compounds, 4-hydroxybenzoic acid esters, 4-hydroxyphthalic acid diesters, phthalic acid monoesters, bis-(hydroxyphenol)sulfides, 4-hydroxyphenylarylsulfones, 4-hydroxyphenylarylsulfonates, 1,3-di[2-(hydroxyphenyl)-2-propyl]benzenes, and other color developers. Specific examples are given below.

bis-Phenol A compounds 4,4'-isopropylidene diphenol (also called bisphenol A),
4,4'-cyclohexylidene diphenol, and
p,p'-(1-methyl-n-hexylidene)diphenol.

4-Hydroxybenzoates

Benzyl 4-hydroxybenzoate,
ethyl 4-hydroxybenzoate,
isopropyl 4-hydroxybenzoate,
butyl 4-hydroxybenzoate,
isobutyl 4-hydroxybenzoate, and
methylbenzyl 4-hydroxybenzoate.

4-Hydroxyphthalic acid diesters

Dimethyl 4-hydroxyphthalate,
diisopropyl 4-hydroxyphthalate,
dibenzyl 4-hydroxyphthalate, and
dihexyl 4-hydroxyphthalate.

Phthalic acid monoesters

Monobenzyl phthalate,
monocyclohexyl phthalate,
monophenyl phthalate,
monomethylphenyl phthalate,
monoethylphenyl phthalate,
monoalkylbenzyl phthalates,
monohalobenzyl phthalates, and
monoalkoxybenzyl phthalates.

bis-(Hydroxyphenyl)sulfides bis-(4-Hydroxy-3-tert-butyl-6-methylphenyl)sulfide,
bis(4-hydroxy-2,5-dimethylphenyl)sulfide,
bis-(4-hydroxy-2-methyl-5-ethylphenyl)sulfide,
bis-(4-hydroxy-2-methyl-5-isopropylphenyl)sulfide,
bis-(4-hydroxy-2,3-dimethylphenyl)sulfide,
bis-(4-hydroxy-2,5-diethylphenyl)sulfide,
bis-(4-hydroxy-2,5diisopropylphenyl)sulfide,
bis-(4-hydroxy-2,3,6-trimethylphenyl)sulfide,
bis-(2,4,5-trihydroxyphenyl)sulfide,
bis-(4-hydroxy-2-cyclohexyl-5-methylphenyl)sulfide,
bis-(2,3,4-trihydroxyphenyl)sulfide,
bis-(4,5-dihydroxy-2-tert-butylphenyl)sulfide,
bis-(4-hydroxy-2,5-diphenylphenyl)sulfide, and
bis(4-hydroxy-2-tert-octyl-5-methylphenyl)sulfide.

4-Hydroxyphenyl arylsulfones

4-Hydroxy-4'-isopropoxydiphenylsulfone,
4-hydroxy-4'-methyldiphenylsulfone, and
4-hydroxy-4'-n-butyloxydiphenylsulfone.

4-Hydroxyphenyl arylsulfonates 4-(Hydroxyphenyl benzenesulfonate,
4-hydroxyphenyl p-tolyllsulfonate,
4-hydroxyphenyl mesitylenesulfonate,
4-hydroxyphenyl p-chlorobenzenesulfonate,
4-hydroxyphenyl p-tert-butylbenzenesulfonate,
4-hydroxyphenyl p-isopropoxybenzenesulfonate,
4-hydroxphenyl 1'-naphthalenesulfonate, and
4-hydroxyphenyl 2'-naphthalenesulfonate.

1,3-Di[2-(hydroxyphenyl)-2-propyl]benzenes 1,3Di[2-(4-hydroxyphenyl)-2-propyl]benzene,
1,3-di[2-(4-hydroxy-3-alkylphenyl)-2-propyl]benzene,
1,3-di[2-(2,4-dihydroxyphenyl)-2-propyl]benzene, and
1,3-di[2-(2-hydroxy-5-methylphenyl)-2-propyl]benzene.

Resorcinols 1,3-Dihydroxy-6(alpha,alpha-dimethylbenzyl)benzene.

Others p-tert-Butylphenol,
2,4-dihydroxybenzophenone,
novolak-type phenolic resins,
4-hydroxyacetophenone,
p-phenylphenol,
benzyl-4-hydroxyphenylacetate, and
p-benzylphenol.

These color developers may be used singly or in combination.

Other organic color developers which can be used preferably in combination with the compound (I) include benzyl 4-hydroxybenzoate, 4-hydroxyphenyl 2'-naphthalenesulfonate, 1,3-di[2(4-hydroxyphenyl)-2-propyl]benzene, 1,3-dihydroxy-6(alpha,alpha-dimethylbenzyl)benzene and 4-hydroxy-4'-isopropoxydiphenylsulfone.

As suggested in the above-cited Japanese Laid-Open Patent Publication No. 144193/1981, benzyl 4-hydroxybenzoate can give a thermosensitvie recording sheet of high sensitivity and excellent dynamic color developability when combined with a fluolane-type dye. But a thermosensitive recording sheet containing this color developer has the defect that the density of an image formed by application of heat is reduced with time or undergoes the "crystallization" phenomenon, and the image area does not have sufficient stability to oily substances. It has been found, however, that by using the compound of formula (I) together, the stability of the image is greatly increased.

The "basic leuco dye" used in the thermosensitive recording sheet of this invention is a basic dye having the property of being normally colorless or light-colored but upon contact with the aforesaid color developers under heat, forming a color. There is no particular restriction on the basic leuco dye used in this invention and any basic leuco dyes heretofore used in thermosensitive recording sheets can equally be used. Generally, leuco dyes of the triphenylmethane, fluolane and azaphthalide types are preferred. Specific examples are shown below.

Triphenylmethane-type leuco dyes 3,3-bis(p-Dimethylaminophenyl)-6-dimethylaminophthalide (also called Crystal Violet Lactone).

Fluolane-type leuco dyes

3-Diethylamino-6-methyl-7-anilinofluolane,
3-(N-ethyl-p-toluidino)-6-methyl-7-anilinofluolane,
3-(N-ethyl-N-isoamyl)amino-6-methyl-7-anilinofluolane,
3-diethylamino-6-methyl-7-(o,p-dimethylanilino)fluolane,
3-pyrrolidino-6-methyl-7-anilinofluolane,
3-piperidino-6-methyl-7-anilinofluorane,
3-(N-cyclohexyl-N-methylamino)-6-methyl-7-anilinofluolane,
3-diethylamino-7-(m-trifluoromethylanilino)fluolane,
3-dibutylamino-7-(o-chloroanilino)fluolane,
3-diethylamino-6-methyl-chlorofluolane,
3-diethylamino-6-methyl-fluolane,
3-cyclohexylamino-6-chlorofluolane,
3-diethylamino-7-(o-chloronanilino)fluolane, and
3-diethylamino-benzo[a]-fluolane.

Azaphthalide-type leuco dyes 3-(4-Diethylamino-2-ethoxyphenyl-3-(1-ethyl-2-methylindol-3-yl)-4-azaphthalide,
3-(4-diethylamino-2-ethoxyphenyl)-3-(1-ethyl-2-methylindol-3-yl)-7-azaphthalide,
3-(4-diethylamino-2-ethoxyphenyl)-3-(1-octyl-2-methylindol-3-yl)-4-azaphthalide, and
3-(4-N-cyclohexyl-N-methylamino-2-methoxyphenyl)-3-(1-ethyl-2-methylindol-3yl)-4-azaphthalide.

These dyes may also be used singly or in combination. In the present invention, a thermosensitive recording sheet having a markedly high dynamic color developing density can be obtained by using 3-diethylamino-6-methyl-7-anilinofluolane, 3-(N-cyclohexyl-N-methylamino)-6-methyl-7-anilinofluolane, 3-(N-ethyl-N-isoamyl)amino-6-methyl-7-anilinofluolane and 3-(4-diethylamino-2-ethoxyphenyl)-3-(1-ethyl-2-methylindol-3-yl)-4-azaphthalide singly as the basic leuco dye.

A thermosensitive recording sheet having excellent oil resistance and storage stability and a high dynamic image density can be obtained when a mixture of 3-diethylamino-6-methyl-7-anilinofluolane and 3-(N-cyclohexyl-N-methylamino)-6-methyl-7-anilinofluolane is used as the basic leuco dye.

The proportion of the color developer containing the compound of formula (I) can be varied over a broad range depending upon the types of the dyes and the color developer. Advantageously, its amount is generally 3 to 10 parts by weight, preferably 2.5 to 3.5 parts by weight, per part by weight of the basic leuco dye.

The color developer and the basic leuco dye are reduced to fine particles having a particle diameter of less than several microns by a grinding machine such as a ball mill, an attriter or a sand grinder, or a suitable emulsifying device, and according to the purpose for which the final product is used, various additives are added. The resulting coating composition is coated on a substrate such as paper or a plastic film, and dried to form a thermosensitive recording layer whose amount of coating is 4 to 10 g/m$^2$ (in a dry condition). As a result, the thermosensitive recording sheet of this invention can be obtained.

The additives which can be blended with the color developer and the basic leuco dye may be those which are used in conventional thermosensitive recording sheets. Examples include binders such as polyvinyl alcohol, modified polyvinyl alcohol, hydroxyethyl cellulose, methyl cellulose, starches, a styrene/maleic anhydride copolymer, a vinyl acetate/maleic anhydride copolymer and a styrene/butadiene copolymer; inorganic or organic fillers such as kaolin, calcined kaolin, diatomaceous earth, talc, titanium oxide and aluminum hydroxide; mold releasing agents such as fatty acid metal salts; lubricants such as waxes; ultraviolet absorbers such as benzophenone compounds and triazole compounds; waterproofing agents such as glyoxal; dispersing agents such as soldium hexametaphosphate and sodium polycarboxylates; defoamers such as acetylene glycol; pressure for preventing agents such as fatty acid amides, ethylenebisamide, montan wax and polyethylene wax; sensitizers such as dibenzyl terephthalate, benzyl p-benzyloxybenzoate, di-p-tolyl carbonate and p-benzylbipenyl; and stabilizers such as phthalic acid monoester metal salts, p-tertiary butylbenzoic acid metal salts and nitrobenzoic acid metal salts. The amounts of these additives are determined depending upon the properties required of the product, its recording suitability, etc., and are not particularly restricted. As tentative standards, they are, for example, 10 to 20% by weight based on the total solids for the binders, and 1 to 20 parts by weight per part by weight of the leuco dye for the fillers. The other components may be used in amounts normally used.

The characteristics and advantages of the thermosensitive recording sheet of this invention are as follows:

(1) Because of its excellent thermal response, it can give a clear high-density image in high-speed and high-density recording.

(2) It has resistance to the adhesion of soiling substances such as hair-dressing agents and oils and fats, and therefore gives images of good stability (good soiling resistance).

(3) Images recorded on it have excellent storage stability. Particularly, the recorded images do not fade under moisture and heat, and do not undergo backgrounding.

(4) It has no sublimability and does not undergo the "crystallization" phenomenon.

(5) It has a white background, and undergoes little backgrounding with time.

The compounds of formula (I) used in this invention are novel compounds not described in the literature. They can be produced, for example, by reacting a hydroxybenzoic acid compound of the following formula

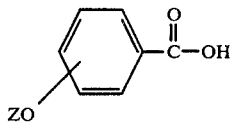

(II)

wherein Z represents a protective group for the hydroxyl group, such as an acyl group, or its reactive derivative (such as its halide) with a hydroxybenzoic acid ester of the following formula

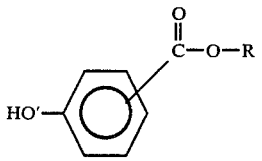

(III)

wherein R is as defined.

For specific conditions employed in this invention, reference may be made to Referential Example A given hereinbelow.

REFERENTIAL EXAMPLE A

A 200 ml. four-necked flask equipped with a condenser tube and a thermometer was charged with 36 g of p-acetoxybenzoic acid and 71.4 g of thionyl chloride, and they were reacted at 50° C. for 4 hours. The excess of thionyl chloride was evaporated under reduced pressure to give p-acetoxybenzoyl chloride. Then, a 300 ml four-necked flask equipped with a condenser tube, a thermometer and a dropping funnel was charged with 45.7 g of benzyl p-hydroxybenzoate, 20.2 g of triethylamine and 100 ml of toluene. The temperature of the flask was raised to 30° C., and a solution of 39.7 g of p-acetoxybenzoyl chloride in 50 g of toluene was added dropwise over 1 hour, and the reaction was carried out at 50° C. for 30 minutes. After cooling, the reaction mixture was washed with three 50 ml portions of water, and the solvent was evaporated under reduced pressure. Recrystallization of the residue from methanol gave benzyl p-(p-acetoxybenzoyloxy)benzoate.

Subsequently, a 100 ml four-necked flask equipped with a condenser tube and a thermometer was charged with 15.6 g of benzyl p-(p-acetoxybenzoyloxy)benzoate, 30 g of 5% sodium hydroxide and 50 ml of tetrahydrofuran, and they were reacted at 30° C. for 5 hours. The reaction product was extracted with 50 ml of toluene. The extract was washed with water, and toluene was evaporated. The residue was separated on a column to give benzyl p-(p-hydroxybenzoyloxy)benzoate as white crystals having a melting point of 137° to 138.5° C.

The following Examples and Comparative Examples typically illustrate the present invention more specifically.

All parts and percentages in these examples are by weight.

EXAMPLES 1-5 AND COMPARATIVE EXAMPLES 1-2

Dispersion A

2-Diethylamino-6-methyl-7-anilinofluolane: 2.0 parts
10% Aqueous solution of polyvinyl alcohol: 4.6 parts
Water: 2.5 parts

Dispersion B

Color developer (see Table 1 below): 6.0 parts
Zinc searate: 0.5 part
10% Aqueous solution of polyvinyl alcohol: 30 parts In each run, the dispersions A and B of the above compositions were each ground to a particle diameter of 3 microns in a ball mill.

Thereafter, 9.1 parts of dispersion A (leuco dye dispersion), 36.5 parts of dispersion B (color developer dispersion), and 12 parts of a 50% dispersion of kaolin clay were mixed to form a coating dispersion. The dispersion was coated on one surface of a substrate paper (basis weight 50 g/m$^2$) at a rate of 6.0 g/m$^2$, and dried. The sheet was then treated with a supercalender so that its degree of smoothness became 200 to 600 seconds. The resulting thermosensitive recording sheet adapted for developing a black color was tested for properties, and the results are shown in Table 1.

TABLE 1

| | | Color developer | |
|---|---|---|---|
| Example | 1 | 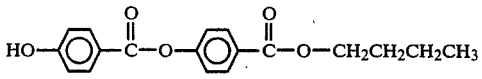 | (m.p. 100-101.5° C.) |
| | 2 | 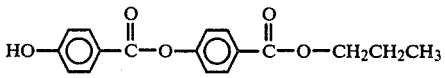 | (m.p. 140-141.5° C.) |
| | 3 | 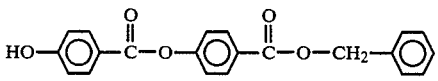 | (m.p. 137-138.5° C.) |
| | 4 | 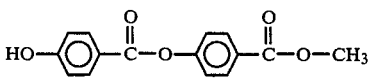 | (m.p. 194-197° C.) |

TABLE 1-continued

| | | | |
|---|---|---|---|
| | 5 | 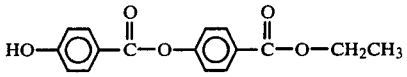 | (m.p. 169–172° C.) |
| Comparative Example | 1 | 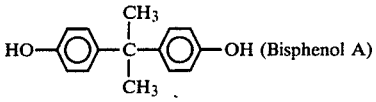 OH (Bisphenol A) | |
| | 2 | 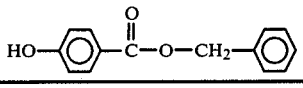 | |

| | | Image density (*1) | | Stability of background (*4) | | | Oil resistance (*7) | | | Crystallization on image surface (*9) |
|---|---|---|---|---|---|---|---|---|---|---|
| | | Static (*2) | Dynamic (*3) | Untreated | Heat resistance (*5) | Moisture resistance (*6) | Untreated | After oil treatment | Residual ratio (%) (*8) | |
| Example | 1 | 1.28 | 1.13 | 0.04 | 0.06 | 0.04 | 1.13 | 0.96 | 85 | O |
| | 2 | 1.27 | 1.10 | 0.04 | 0.05 | 0.04 | 1.10 | 0.95 | 86 | O |
| | 3 | 1.25 | 1.08 | 0.04 | 0.05 | 0.04 | 1.08 | 0.91 | 84 | O |
| | 4 | 1.27 | 1.11 | 0.04 | 0.05 | 0.04 | 1.11 | 0.92 | 83 | O |
| | 5 | 1.28 | 1.12 | 0.04 | 0.06 | 0.04 | 1.12 | 0.95 | 85 | O |
| Comparative Example | 1 | 0.27 | 0.60 | 0.08 | 0.10 | 0.09 | 0.60 | 0.59 | 98 | O |
| | 2 | 1.35 | 1.32 | 0.04 | 0.15 | 0.05 | 1.32 | 0.80 | 61 | X |

O: Hardly any crystallization was observed.
X: Considerable crystallization was observed.

Note to Table 1

(*1): Image density Measured by a Macbeth densitometer (RD-514 with an amber filter: the Macbeth densitometers mentioned hereinafter are the same as this one).

(*2): Static image density The recording sheet was pressed against a hot plate heated at 105° C. under a pressure of 10 g/cm$^2$ for 5 seconds, and the density of the formed color was measured by the Macbeth densitometer.

(*3): Dynamic image density The density of an image recorded on the thermosensitive recording sheet by a thermosensitive facsimile (CP-4800A made by Tokyo Shibaura Electric Co., Ltd.) with a pulse width of 0.7 millisecond in GIII mode was measured by the Macbeth densitometer.

(*4) Stability of the background The optical density of an uncolored portion of the recording sheet was measured by the Macbeth densitometer.

(*5) Heat resistance The recording sheet was left to stand under a drying conditions at 60° C. for 24 hours, and the optical density of its background was measured.

(*6): Moisture resistance The recording sheet was left to stand at 40° C. and 90% RH for 24 hours, and the optical density of its background was measured.

(*7): Oil resistance A droplet (0.8 mg) of castor oil dropped onto a glass plate by an injection syringe was spread to an area of 40 cm$^2$. Then, by using a rubber stamp (1 cm × 1.5 cm), the oil was transferred to that surface of the recording sheet which developed a color in accordance with the procedure described in (*3) above. After standing for 7 days, the density of the color in the transferred portion was measured by the Macbeth densitometer.

(*8): Residual ratio of image density Calculated in accordance with the following equation.

$$\text{Residual ratio} = \frac{\text{Image density after oil treatment}}{\text{Image density of the untreated sample}} \times 100\ (\%)$$

(*9): Crystallization on the image surface The thermosensitive recording sheet dynamically colored by the method described in (*3) was stored in a file for one month at room temperature. The degree of formation of crystals on the colored image surface was determined by visual observation.

It is seen from Table 1 that the thermosensitive recording sheets containing the hydroxybenzoyloxybenzoic acid esters of the invention as the color developer (Examples 1 to 5) have a higher dynamic image density and a better background color and background density preservability than the thermosensitive sheet containing bisphenol A as the color developer (Comparative Example 1), and have better background color, background density preservability, oil resistance and resistance to crystallization than the thermosensitive recording sheet containing benzyl p-hydroxybenzoate as the color developer (Comparative Example 2).

EXAMPLE 6

Dispersion A

3-Diethylamino-6-methyl-7-anilinofluolane: 2.0 parts
10% Aqueous solution of polyvinyl alcohol: 4.6 parts
Water: 2.5 parts

Dispersion C

Bisphenol A: 5 parts
Zinc stearate: 1 part
10% Aqueous solution of polyvinyl alcohol: 29.5 parts
Water: 5.5 parts

Dispersion D

Benzyl 4-hydroxybenzoyloxybenzoate: 2 parts
10% Aqueous solution of polyvinyl alcohol: 5 parts
Water: 3 parts The above dispersions were each ground to a particle diameter of 3 microns by an attriter.

Then, 9.1 parts of dispersion A (leuco dye dispersion), 41 parts of dispersion C (color developer dispersion), 10 parts of dispersion D (color developer dispersion) and 20 parts of a 50% dispersion of kaolin clay were mixed. The resulting coating dispersion was coated on one surface of a substrate paper (basis weight 50 g/m$^2$) at a rate of about 6.0 g/m$^2$ and dried. The resulting sheet was treated with a supercalender so that its degree of smoothness became 200 to 600 seconds to obtain a thermosensitive recording sheet.

EXAMPLES 7–8

Thermosensitive recording sheets were obtained by repeating Example 6 except that in the preparation of the coating dispersion, the amount of the color developer dispersion D (10 parts) was changed to 5 and 1.25 parts, respectively.

The thermosensitive recording sheets obtained in Examples 6 to 8 were tested for properties in the same way as the previous Examples. The results are shown in Table 2.

The dynamic image density and record preservability, however, were measured by the following methods.

(1) Dynamic image density

The density of an image recorded on the thermosensitive recording sheet by a thermosensitive print tester (THP 8050 made by ROHM) with a pulse width of 1.02 milliseconds at an applied voltage of 16.5 V was measured by the Macbeth densitometer.

(2) Record preservability

The density of an image recorded on the thermosensitive recording sheet by a thermosensitive facsimile (KB-4800 made by Tokyo Shibaura Electric Co., Ltd.) at an applied voltage of 18.03 V with a pulse width of 3.2 milliseconds was measured by the Macbeth densitometer.

TABLE 2

| Example | Color developer | Image density: Static | Image density: Dynamic (1) |
|---|---|---|---|
| 6 | 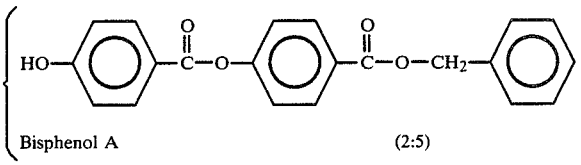 Bisphenol A (2:5) | 0.87 | 0.17 |
| 7 | 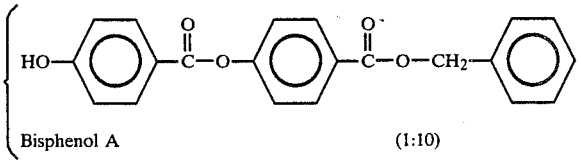 Bisphenol A (1:10) | 0.85 | 0.16 |
| 8 | 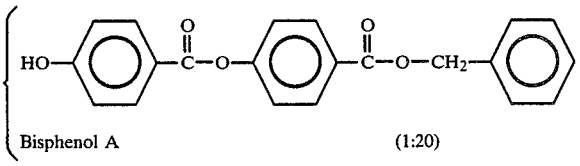 Bisphenol A (1:20) | 0.80 | 0.15 |

| Example | Stability of background: Untreated | Stability of background: Moisture resistance | Stability of background: Heat resistance | Record preservability (2): Untreated | Record preservability (2): Moisture resistance | Record preservability (2): Heat resistance | Oil resistance: Untreated | Oil resistance: After Oil treatment | Oil resistance: Residual ratio (%) |
|---|---|---|---|---|---|---|---|---|---|
| 6 | 0.04 | 0.07 | 0.07 | 1.02 | 1.25 | 1.15 | 1.02 | 1.02 | 100 |
| 7 | 0.04 | 0.07 | 0.07 | 1.01 | 1.23 | 1.13 | 1.01 | 0.98 | 97 |
| 8 | 0.05 | 0.08 | 0.08 | 1.00 | 1.20 | 1.12 | 1.00 | 0.95 | 95 |

EXAMPLE 9

Dispersion E

3-Diethylamino-6-methyl-7-anilinofluolane: 2.0 parts
10% Aqueous solution of polyvinyl alcohol: 4.6 parts
Water: 2.5 parts

Dispersion F

Benzyl 4-hydroxybenzoate: 5 parts
Zinc sterate: 1 part
10% Aqueous solution of polyvinyl alcohol: 29.5 parts
Water: 5.5 parts

Dispersion G

Benzyl 4-hydroxybenzoyloxybenzoate: 2 parts
10% Aqueous solution of polyvinyl alcohol: 5 parts
Water: 3 parts The dispersion were each ground to a particle diameter of 3 microns by an attriter.

Then, 9.1 parts of dispersion E (leuco dye dispersion), 41 parts of dispersion F (color developer dispersion), 10 parts of dispersion G (color developer dispersion) and 20 parts of a 50% dispersion of kaolin clay were mixed to form a coating dispersion.

A thermosnsitive recording sheet was prepared by using the coating dispersion in the same as in Example 6.

EXAMPLE 10

Example 9 was repeated exept that in the preparation of the coating dispersion, the amount of the dispersion G was changed to 2.5 parts.

COMPARATIVE EXAMPLE 3

Example 9 was repeated excpet that dispersion G was not used.

EXAMPLE 11

Dispersion H

3-Diethylamino-6-methyl-7-anilinofluolane: 2.0 parts
10% Aqueous solution of polyvinyl alcohol: 4.6 parts
Water: 2.5 parts Dispersion I 4-Hydroxy-4'-isopropoxydiphenylsulfone: 5 parts
Zinc stearate: 1 part
10% Aqueous solution of polyvinyl alcohol: 29.5 parts
Water: 5.5 parts Dispersion J Butyl 4-hydroxybenzoyloxy benzoate: 2 parts
10% Aqueous solution of polyvinyl alcohol: 5 parts
Water: 3 parts The above dispersions were each ground to a particle diameter of 3 microns by an attriter.

Then, 9.1 parts of dispersion H (leuco dye dispersion), 41 parts of dispersion I (color developer dispersion), 10 parts of dispersion J (color developer dispersion) and 20 parts of a 50% dispersion of kaolin clay were mixed to form a coating dispersion. A thermosensitive recording sheet was prepared by using the coating dispersion in the same way as in Example 6.

EXAMPLE 12

Example 11 was repeated except that in the preparation of the coating dispersion, the amount of dispersion J was changed to 2.5 parts.

COMPARATIVE EXAMPLE 4

A thermosensitive recording sheet was prepared in the same way as in Example 11 except that dispersion J was not used.

EXAMPLE 13

Dispersion K

3-Diethylamino-6-methyl-7-anilinofluolane: 2.0 parts
10% Aqueous solution of polyvinyl alcohol: 4.6 parts
Water: 2.5 parts Dispersion L 4-Hydroxyphenyl 2'-naphthalenesulfonate: 5 parts
Zinc stearate: 1 part
10% Aqueous solution of polyvinyl alcohol: 29.5 parts
Water: 5.5 parts Dispersion M Propyl 4-hydroxybenzoyloxybenzoate: 2 parts
10% Aqueous solution of polyvinyl alcohol: 5 parts
Water: 3 parts The above dispersions were each ground to a particle diameter of 3 microns by an attriter.

Then, 9.1 parts of dispersion K (leuco dye dispersion), 41 parts of dispersion L (color developer dispersion), 10 parts of dispersion M (color developer dispersion) and 20 parts of a 50% dispersion of kaolin clay were mixed to form a coating dispersion. A thermosensitive recording sheet was prepared by using the coating dispersion in the same way as in Example 6.

EXAMPLE 14

Example 13 was repeated except that in the preparation of the coating dispersion, the amount of dispersion M was changed to 2.5 parts.

COMPARATIVE EXAMPLE 5

Example 13 was repeated except that dispersion M was not used.

EXAMPLE 15

Dispersion N

3-Diethylamino-6-methyl-7-anilinofluolane: 2.0 parts
10% Aqueous solution of polyvinyl alcohol: 4.6 parts
Water: 2.5 parts Dispersion O 1,3-di[2-(4-hydroxyphenyl)-2-propyl]benzene: 5 parts
Zinc stearate: 1 part
10% Aqueous solution of polyvinyl alcohol: 29.5 parts
Water: 5.5 parts Dispersion P Methyl 4-hydroxybenzoyloxybenzoate: 2 parts
10% Aqueous solution of polyvinyl alcohol: 5 parts
Water: 3 parts The above dispersions were each ground to a particle diameter of 3 microns by an attriter.

Then, 9.1 parts of dispersion N (leuco dye dispersion), 41 parts of dispersion O (color developer dispersion), 10 parts of dispersion P (color developer dispersion) and 20 parts of a 50% dispersion of kaolin clay were mixed to form a coating dispersion. A thermosensitive recording sheet was prepared by using the coating dispersion in the same way as in Example 6.

EXAMPLE 16

Example 15 was repeated except that the amount of dispersion P was changed to 2.5 parts in the preparation of the coating dispersion.

COMPARATIVE EXAMPLE 6

Example 15 was repeated except that dispersion P was not used.

EXAMPLE 17

Dispersion Q

3-Diethylamino-6-methyl-7-anilinofluolane: 2.0 parts
10% Aqueous solution of polyvinyl alcohol: 4.6 parts
Water: 2.5 parts Dispersion R

[1,3-Dihydroxy-6-(alpha,alpha-dimethylbenzyl)]benzene: 5 parts
Zinc stearate: 1 part
10% Aqueous solution of polyvinyl alcohol: 29.5 parts
Water: 5.5 parts Dispersion S Ethyl 4-hydroxybenzoyloxybenzoate: 2 parts
10% Aqueous solution of polyvinyl alcohol: 5 parts
Water: 3 parts The above dispersions were each ground to a particle diameter of 3 microns by an attriter.

Then, 9.1 parts of dispersion Q (leuco dye dispersion), 41 parts of dispersion R (color developer dispersion), 10 parts of dispersion S (color developer dispersion), and 20 parts of a 50% dispersion of kaolin clay were mixed to form a coating dispersion. A thermosensitive recording sheet was prepared by using the coating dispersion in the same way as in Example 1.

EXAMPLE 18

Example 17 was repeated except that the amount of dispersion S was changed to 2.5 parts.

COMPARATIVE EXAMPLE 7

Example 17 was repeated except that dispersion S was not used.

The thermosensitive recording sheets obtained in Examples 9 to 18 and Comparative Examples 3 to 7 were tested for properties by the same methods as in Example 6. The results are summarized in Table 3.

TABLE 3

| Example (Ex.) or Comparative Example (CEx.) | Color developer | | Image density | | Stability of background | | | Record preservability (2) | | | Oil resistance | | |
|---|---|---|---|---|---|---|---|---|---|---|---|---|---|
| | | | Static | Dynamic | Un-treated | Moisture resistance | Heat resistance | Un-treated | Moisture resistance | Heat resistance | Un-treated | After oil treatment | Residual ratio (%) |
| Ex. 9 | 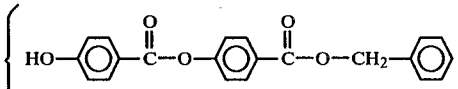 Benzyl 4-hydroxybenzoate | (2:5) | 1.37 | 0.65 | 0.03 | 0.06 | 0.10 | 1.28 | 1.41 | 1.41 | 1.28 | 1.24 | 97 |
| Ex. 10 | 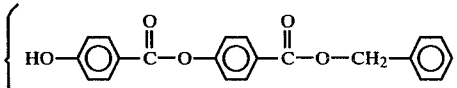 Benzyl 4-hydroxybenzoate | (1:10) | 1.36 | 0.60 | 0.03 | 0.06 | 0.11 | 1.29 | 1.38 | 1.38 | 1.29 | 1.16 | 90 |
| CEx. 3 | Benzyl 4-hydroxybenzoate alone | | 1.35 | 0.35 | 0.04 | 0.05 | 0.15 | 1.32 | 1.23 | 1.22 | 1.32 | 0.80 | 61 |
| Ex. 11 | 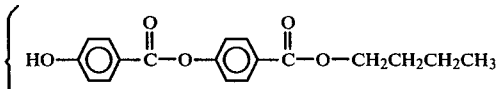 4-Hydroxy-4'-isopropoxydiphenylsulfone | (2:5) | 1.15 | 0.28 | 0.04 | 0.05 | 0.06 | 1.15 | 1.27 | 1.30 | 1.15 | 1.15 | 100 |
| Ex. 12 | 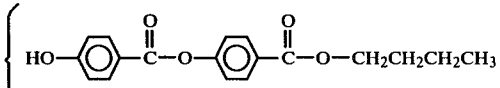 4-Hydroxy-4'-isopropoxydiphenylsulfone | (1:10) | 1.05 | 0.24 | 0.04 | 0.05 | 0.06 | 1.13 | 1.25 | 1.28 | 1.13 | 1.07 | 95 |
| CEx. 4 | 4-Hydroxy-4'-isopropoxydiphenylsulfone alone | | 0.57 | 0.13 | 0.04 | 0.05 | 0.07 | 0.98 | 1.14 | 1.23 | 0.98 | 0.83 | 85 |
| Ex. 13 | 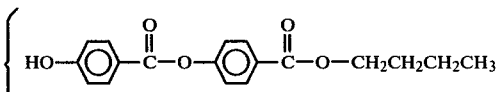 4-Hydroxyphenyl-2'-naphthalenesulfonate | (2:5) | 1.20 | 0.29 | 0.04 | 0.06 | 0.07 | 1.15 | 1.27 | 1.30 | 1.15 | 1.15 | 100 |
| Ex. 14 | 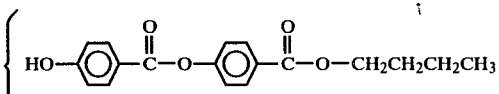 4-Hydroxyphenyl-2'-naphthalenesulfonate | (1:10) | 1.15 | 0.25 | 0.04 | 0.06 | 0.07 | 1.14 | 1.26 | 1.28 | 1.14 | 1.11 | 97 |
| CEx. 5 | 4-Hydroxyphenyl-2'-naphthalenesulfonate alone | | 0.93 | 0.15 | 0.04 | 0.06 | 0.08 | 0.99 | 1.15 | 1.21 | 0.99 | 0.89 | 90 |

TABLE 3-continued

| Example (Ex.) or Comparative Example (CEx.) | Color developer | | Color density | | White sheet preservability | | | Record preservability (2) | | | Oil resistance | | |
|---|---|---|---|---|---|---|---|---|---|---|---|---|---|
| | | | Static | Dynamic | Un-treated | Moisture resistance | Heat resistance | Un-treated | Moisture resistance | Heat resistance | Un-treated | After oil treatment | Residual ratio (%) |
| Ex. 15 | 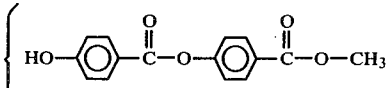 1,3-Di[2-(4-hydroxyphenyl)-2-propyl]benzene | (2:5) | 1.15 | 0.25 | 0.04 | 0.07 | 0.07 | 1.17 | 1.28 | 1.30 | 1.17 | 1.17 | 100 |
| Ex. 16 | 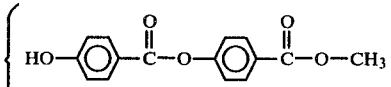 1,3-Di[2-(4-hydroxyphenyl)-2-propyl]benzene | (1:10) | 1.11 | 0.23 | 0.04 | 0.07 | 0.07 | 1.14 | 1.27 | 1.28 | 1.14 | 1.07 | 94 |
| CEx. 6 | 1,3-Di[2-(4-hydroxyphenyl)-2-propyl]benzene alone | | 0.37 | 0.12 | 0.05 | 0.07 | 0.08 | 0.98 | 1.13 | 1.06 | 0.98 | 0.85 | 87 |
| Ex. 17 | 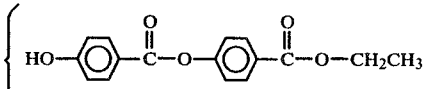 1,3-Dihydroxy-6-(alpha,alpha-dimethylbenzyl)-benzene | (2:5) | 1.24 | 0.33 | 0.27 | 0.11 | 0.11 | 1.12 | 1.22 | 1.25 | 1.12 | 1.12 | 100 |
| Ex. 18 | 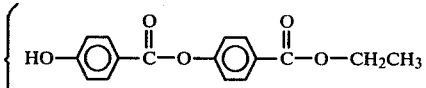 1,3-Dihydroxy-6-(alpha,alpha-dimethylbenzyl)-benzene | (1:10) | 1.22 | 0.28 | 0.04 | 0.11 | 0.11 | 1.12 | 1.21 | 1.24 | 1.12 | 1.11 | 99 |
| CEx. 7 | 1,3-Dihydroxy-6-(alpha,alpha-dimethylbenzyl)-benzene alone | | 1.17 | 0.12 | 0.04 | 0.11 | 0.11 | 1.11 | 1.15 | 0.98 | 1.11 | 1.05 | 95 |

A comparison of Examples with the corresponding Comparative Examples on the basis of the data given in Table 3 shows that when the compound of formula (I) of this invention is used in combination with another color developer, the dynamic image density is increased and the stability of images indicated by their background stability, record preservability and oil resistance is improved.

When the thermosensivie recording sheet of Comparative Example 3 was stored in a file for one month at room temperature, the defect of the benzyl 4-hydroxybenoate used appeared, and considerable crystallization was seen on the surface of the recorded image. In the corresponding thermosensitive recording sheets of Examples 9 and 10, this defect was eliminated, and no crystallization occurred.

What we claim is:

1. A thermosensitive recording sheet having a thermosensitive color developing layer containing a basic leuco dye and an organic color developer, said organic color developer consisting at least partly of a hydroxybenzoyloxybenzoic acid ester represented by the general formula (I)

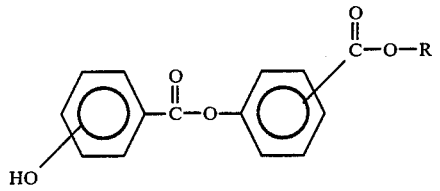

(I)

wherein R represents an alkyl group, a cycloalkyl group, or an aryl, aralkyl or aryloxyalkyl group which may have at least one substituent selected from the class consisting of halogen atoms, nitro groups, hydroxyl groups, lower alkyl groups and lower alkoxy groups.

2. The thermosensitive recording sheet of claim 1 wherein R is an alkyl group having 1 to 12 carbon atoms, a cycloalkyl group having 5 to 10 carbon atoms, or a group of the following formula

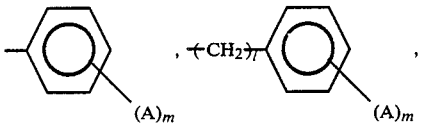

-continued

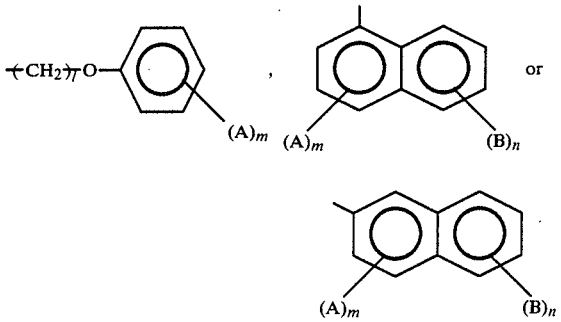

wherein A and B, independently from each other, represents a halogen atom, a nitro group, a hydroxyl group, a lower alklyl group or a lower alkoxy group, l is an integer of 1 to 5, and m and n are each 0 or an integer of 1 to 3 provided that when m and n are 2 or 3, two or three groups A or B are identical or different.

3. The thermosensitive recording material of claim 1 wherein the hydroxybenzoyloxybenzoic acid ester is represented by the following general formula

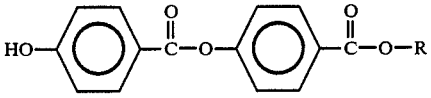

(I-1)

wherein R is as defined in claim 1.

4. The thermosensitive recording sheet of claim 3 wherein R represents an alkyl group having 1 to 12 carbon atoms, a cyclohexyl group, a benzyl group, a phenethyl group, an alpha-naphthyl group, or a beta-naphthyl group.

5. The thermosensitive recording sheet of claim 1 wherein the proportion of the hydroxybenzoyloxybenzoic acid ester of formula (I) is at least 50% by weight based on the total weight of the organic color developer when it is used mainly for color developer function.

6. The thermosensitive recording sheet of claim 1 wherein the organic color developer consists of the hydroxybenzoyloxybenzoic acid ester of formula (I) used mainly for a stabilizing effect and another organic color developer, and the amount of the hydroxybenzoyloxybenzoic acid ester of formula (I) is 0.1 to 35% by weight based on the total weight of the organic color developer.

7. The thermosensitive recording sheet of claim 6 wherein the other organic color developer is a 4-hydroxyphenyl compound selected from the group consisting of benzyl 4-hydroxybenzoate, 4-hydroxyphenyl-2'-naphthalenesulfonate, 1,3-di[2-(4-hydroxyphenyl)-2-propyl]benzene, 1,3-dihydroxy-5-(alpha,alpha-dimethylbenzyl)benzene and 4-hydroxy-4'-isopropoxydiphenylsulfone.

* * * * *